US006099402A

United States Patent [19]

Abe et al.

[11] Patent Number: 6,099,402

[45] Date of Patent: Aug. 8, 2000

[54] SMALL APPARATUS FOR DISPENSING CIRCULAR PLATE OBJECTS

[75] Inventors: Hiroshi Abe; Noboru Ichihara, both of Iwatsuki, Japan

[73] Assignee: Asahi Seiko Co. Ltd., Tokyo, Japan

[21] Appl. No.: 09/151,531

[22] Filed: Sep. 11, 1998

[30] Foreign Application Priority Data

| | | | |
|---|---|---|---|
| Sep. 12, 1997 | [JP] | Japan | 9-287541 |
| Sep. 18, 1997 | [JP] | Japan | 9-291470 |
| Dec. 19, 1997 | [JP] | Japan | 9-370005 |

[51] Int. Cl.[7] ..... G07D 1/00

[52] U.S. Cl. ..... 453/57; 221/241

[58] Field of Search ..... 453/13, 33, 49, 453/57; 221/241; 222/305

[56] References Cited

U.S. PATENT DOCUMENTS

| | | | |
|---|---|---|---|
| 2,959,324 | 11/1960 | Hendrickson et al. | 221/241 X |
| 5,316,517 | 5/1994 | Chiba | 453/57 |
| 5,711,704 | 1/1998 | Hughes et al. | 453/57 |

FOREIGN PATENT DOCUMENTS 3602291 7/1989 Germany .

*Primary Examiner*—F. J. Bartuska
*Attorney, Agent, or Firm*—Quirk & Tratos

[57] ABSTRACT

An apparatus for dispensing disc bodies such as coins or tokens is set forth which includes a fixed substrate and a dispensing disc spaced from said substrate a distance related to the thickness of said disc bodies. The dispensing disc includes a plurality of openings having a diameter adapted to receive a disc body for dispensing thereof. The dispensing disc is attached to a shaft which is axially moveable to adjust the space between the dispensing disc and substrate. The shaft is connected to a motor through an axially aligned planetary gear apparatus. Rotation of the dispensing disc receives coins or tokens in the openings and space whereupon the coins are moved for dispensing. An elevation body engages the dispensing disc and includes a plurality of annular teeth. An adjustment body has teeth to engage the elevation body teeth. Rotation of the adjustment body axially adjusts the elevation body and dispensing disc to adjust the space to accept different thicknesses of coins.

7 Claims, 6 Drawing Sheets

SMALL APPARATUS FOR DISPENSING CIRCULAR PLATE OBJECTS

FIELD OF THE INVENTION

This invention relates to a discharge apparatus for disc bodies for discharging a disc type coin such as money and a disc type medal used in a game machine. Especially, this invention relates to a discharge apparatus for disc bodies which can simply regulate the thickness depending on the thickness of the desired disc body for which a discharge is desired. Furthermore, this invention relates to a discharge apparatus for changeable disc bodies which can simply regulate the size depending on the size of the disc body. In other words, this invention relates to a discharge apparatus simply applicable to the size of each country coin depending on the coin of each country.

Especially, this invention relates to the discharge apparatus for the disc bodies which can simply change the size of a discharge hole corresponding to the size of the desired disc body which desires a discharge. In other words, this invention relates to the discharge apparatus for the disc bodies which can simply change the size of a discharge hole corresponding to the size of the various coins of each country.

BACKGROUND OF THE INVENTION

As to the discharge apparatus for the conventional disc bodies, the shaft which rotates the disc (for example, the reference number 22 of FIG. 1) for discharging each coin was a revolving shaft of a gear apparatus. And, the revolving shaft (for example, the reference number 19 of FIG. 1) of a gear apparatus had gear with the rotating shaft of an electric motor. In other words, as to the discharge apparatus for the conventional disc bodies, the disc for a coin discharge was arranged beside (off set from) the rotating shaft of an electric motor. In other words, as to the discharge apparatus for the conventional disc bodies, the disc for a coin discharge was arranged beside the rotating shaft of an electric motor and was fixed to the revolving shaft of the coupled gear apparatus.

Moreover, the washer (not shown) depending on the thickness of the coin was installed to the revolving shaft of the disc for a coin discharge. In other words, the height of the thickness for a substrate (for example, the reference number 11 of FIG. 1), i.e., the height of the coin disc, was adjusted with the washer.

Therefore, the rotating shaft of an electric motor and the revolving shaft of the gear apparatus arranged horizontally are arranged in parallel. However, since these revolving shafts are in a separated position mutually, the whole apparatus becomes large horizontally. In addition, since the revolving shafts of a gear apparatus was locked by screw to the disc for a discharge when a user exchanged the disc for a coin discharge, removal was complicated.

Moreover, when the washer for adjusting the thickness of the coin was mounted, the user needed to remove the disc for a discharge, or the user needed to remove the revolving shafts.

A discharge apparatus for the conventional disc bodies is shown in FIG. 7. A discharge apparatus is equipped with the disc for discharging the coin each one. A rotating shaft is inserted in the center section of a disc as to the discharge apparatus of FIG. 7. And, the coin is discharged when the disc is rotated. In other words, the disc for discharging a coin is fixed to the revolving shaft of the gear apparatus coupled with the electric motor as to the conventional discharge apparatus for disc bodies.

Therefore, the disc for discharging a coin needed to be exchanged depending on the size of the coin discharged. And, the disc for a discharge was fixed with the screw to the revolving shaft of a gear apparatus. Therefore, the removal was complicated.

SUMMARY OF THE INVENTION

It is an object of this invention to provide for a discharge apparatus for disc bodies which has a small and simple structure, which can easily change the disc for a coin discharge by one-touch and to which the regulation of the coin thickness is made extremely easily.

It is a further object of this invention to provide for a discharge apparatus of the disc body which can simply change the size of a discharge hole depending on the size of the disc body which desires a discharge and for which the disc for a discharge is simply changeable depending on the required coin size.

The invention offers a discharge apparatus for disc bodies which has a small and simple structure by arranging the rotating axle line of an electric motor, and the axis of rotation of a gear apparatus on the same straight line.

The discharge apparatus of this invention can easily exchange the discs for discharging coin by one-touch. Especially, the discharge apparatus by this invention can also perform a regulation of the coin thickness extremely simply.

BRIEF DESCRIPTION OF THE DRAWINGS

It follows a description of embodiments of this invention, referring to the attached drawings of which.

DESCRIPTION

Figure 1:
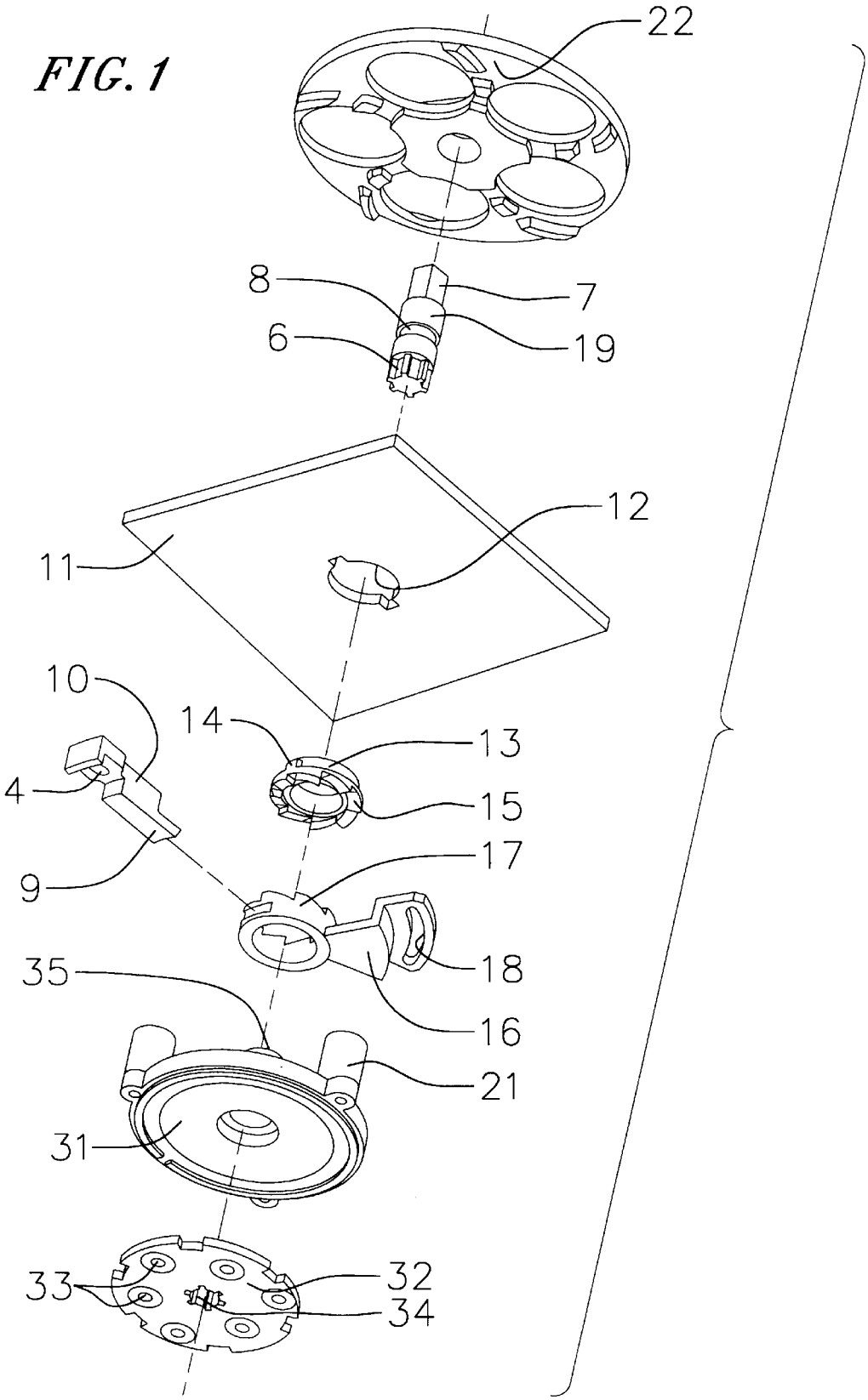
FIG. 1 is a generally perspective, exploded view of the present invention.

With reference to FIG. 1, a large square plate member defines a substrate 11 for attachments. The central part of the substrate 11 is equipped with keyed through-hole 12. The circle ring type small elevation body 13 is made from resin. The upper half of the elevation body 13 can elevate the inside of the through-hole 12 freely. In addition, the upper half of the elevation body 13 is equipped with a protrusion 14 of a detent. Therefore, it is desirable that the keys of the through-hole 12 and the elevation body 13 can elevate the inside of the through-hole 12 and the elevation body 13 are cooperative square to provide for axial movement of the elevational body.

The lower half of the elevation body 13 is elongated to prevent the elevation body 13 from coming out of the through-hole 12. The bottom of the elevation body 13 provides a plurality of saw-teeth 15. A magnifying-glass type operation body 16 shown in the central part of FIG. 1 may be made from resin. The top part of a ring part thereof provides a saw-teeth 17. The saw-teeth 17 can mesh with the saw-teeth 15 of the elevation body 13. In addition, the haft part of the operation body 16 includes an arc type long hole 18. The operation body 16 is fixed by a screw to the undersurface of the substrate 11 via the long hole 18.

Figure 3:
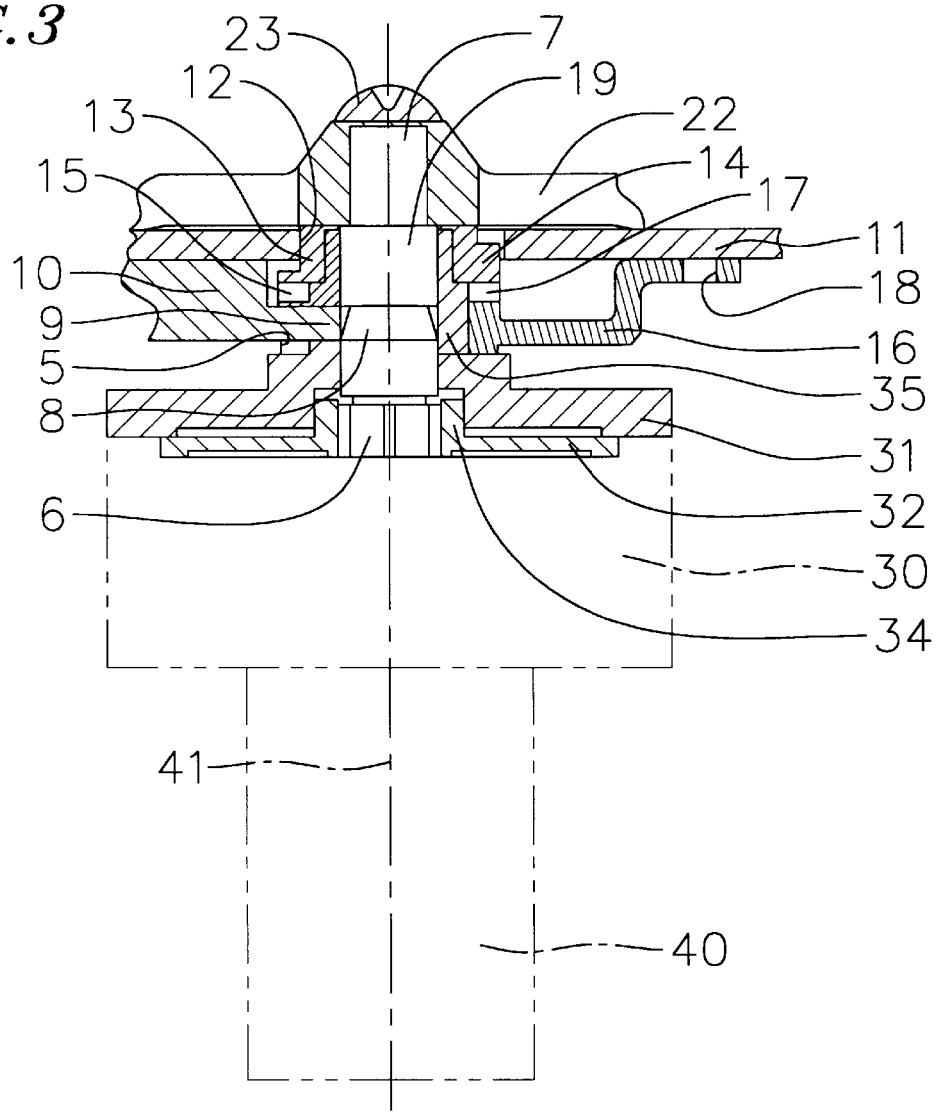
FIG. 3 is a section view of the apparatus of FIG. 2.

As to the bottom of FIG. 1, a ring type thick fairly large cover plate 31 cooperates to enclose a planetary gear apparatus 30 (refer FIG. 3). This cover plate 31 is fixed to the undersurface of the substrate 11 via plurality screws passing through collars 21.

A short revolving shaft 19 is inserted in the through-hole 12, the ring type elevation body 13, the ring part of the operation body 16 and the cover plate 31 as shown in top part of FIG. 1 to rotate freely thereon. A disc 22 is coupled to the upper-part end of the revolving shaft 19. The disc 22 is fixed to the revolving shaft 19 by means of a screw 23 (refer FIG. 3). In other words, the revolving shaft 19 is fixed integrally in the center of the disc 22. Therefore, the disc 22 and the revolving shaft 19 may be integrally formed by sintered metal, etc.

As to the left part of the center of FIG. 1, there is included a stopper 10. The stopper 10 is equipped with a wedge part 9 of a tooth shape. The stopper 10 prevents the revolving shaft 19 from coming off the assembly. The short revolving shaft 19 is explained below. The revolving shaft 19 is made from a metal. The revolving shaft 19 is equipped with a cone part 8. The upper end part of the revolving shaft 19 comprises a D shape nut part 7 received through a cooperatively shaped hole in the disc 22. The lower-end part of the revolving shaft 19 comprises a hexagonal gear part 6. Furthermore, the disc type thick planet-gear apparatus in FIG. 3 is explained here.

First, the projection edge part of the cylinder type rotating shaft (not shown) of the electric motor 40 is equipped with a small sun type gear (not shown). And, a plurality of planet gears (not shown) is arranged so that it may gear around a sun type gear. Furthermore, a large internal-tooth gear (not shown) which gears with a planet gear is fixed. And, each shaft of a planet gear is rotatably inserted in a hole 33 of a carrier board 32 (see FIG. 1). Therefore, if the electric motor 40 is operated, the carrier board 32 and gear arrangement will reduce speed and rotate the shaft 19.

The carrier board 32 is equipped with a splined bore 34 at a central part. The gear part 6 of the revolving shaft 19 is cooperatively splined for insertion through the cylinder bore 34.

Figure 2:
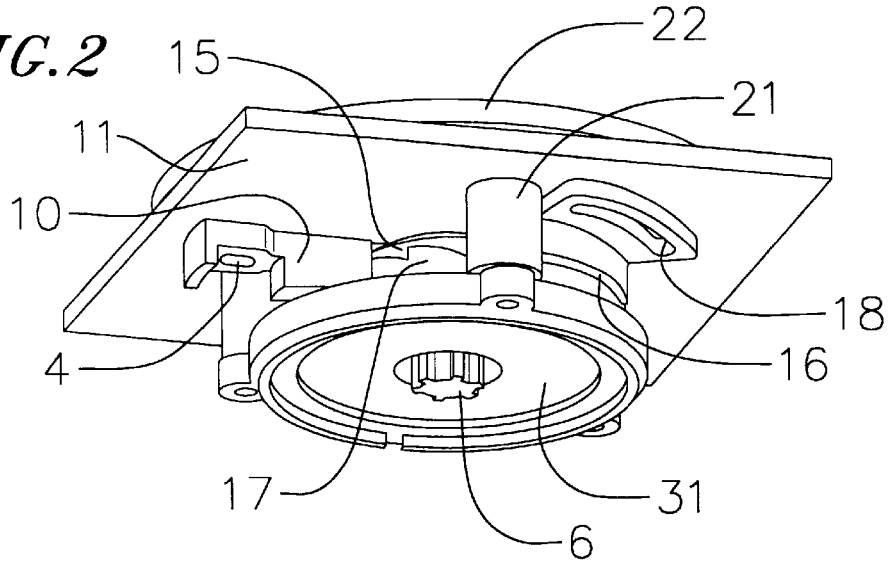
FIG. 2 is a generally perspective assembled view of apparatus of FIG. 1.

As to the discharge apparatus of this example which consists of the above mentioned component, as shown in FIG. 2 and 3, the upper half of the elevation body 13 is first positioned and vertically movable through the through-hole 12 of the substrate 11. And, the ring part of the operation body 16 is in contact with the bottom of the elevation body 13. The saw-teeth 15 and 17 gear and the haft part of the operation body 16 is fixed by connection of the operation body 16 to the undersurface of the substrate 11. That is, a screw (not shown) is inserted in the long hole 18 of the haft part of the operation body 16 and is fixed to the undersurface of the substrate 11.

Next, as to the undersurface of the substrate 11, the planet-gear apparatus 30 and the electric motor 40 are attached via a plurality of collars 21 and the cover plate 31. And, the nut part 7 of the revolving shaft 19 is penetrated in the central hole of the disc 22 and is fixed by a screw 23 (refer FIG. 3). After this, the gear part 6 of the revolving shaft 19 is through the ring type elevation body 13, the ring part of the operation body 16 and the ring type cover plate 31.

The gear part 6 is further inserted in the cylinder bore 34 of the carrier board 32 of the planetary gear apparatus 30 and is geared mutually. Hereafter, the wedge part 9 at the end of the stopper 10 is penetrated via the long hole 5 of the ring part in the operation body 16 and the hole of the cylinder part 35 which is formed in the central part of the cover plate 31. In this way, the wedge part 9 contacted with the cone part 8 of the revolving shaft 19 thereby the revolving shaft 19 is prevented (refer FIG. 3) from coming off and releasing the disc 22. In addition, the stopper 10 is locked by screw (not shown) on the undersurface of the substrate 11 via the long hole 4 of an element edge part.

Figure 4A:
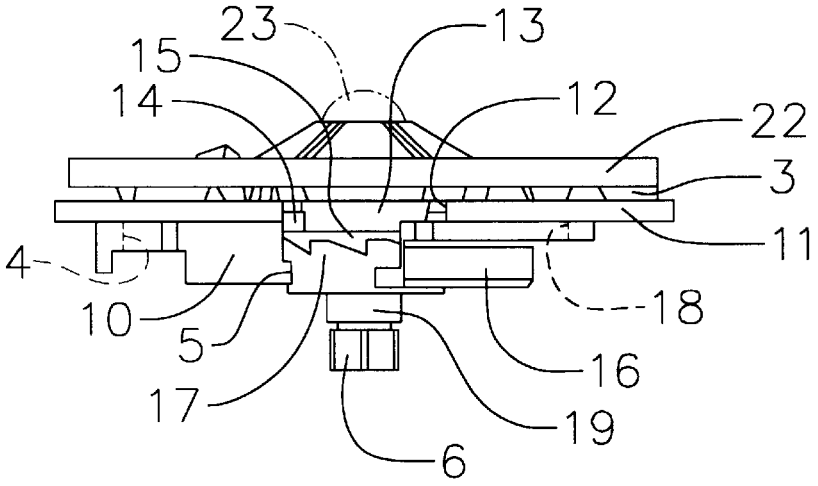
FIG. 4A is a side view of the apparatus showing a first relative position.
Figure 4B:
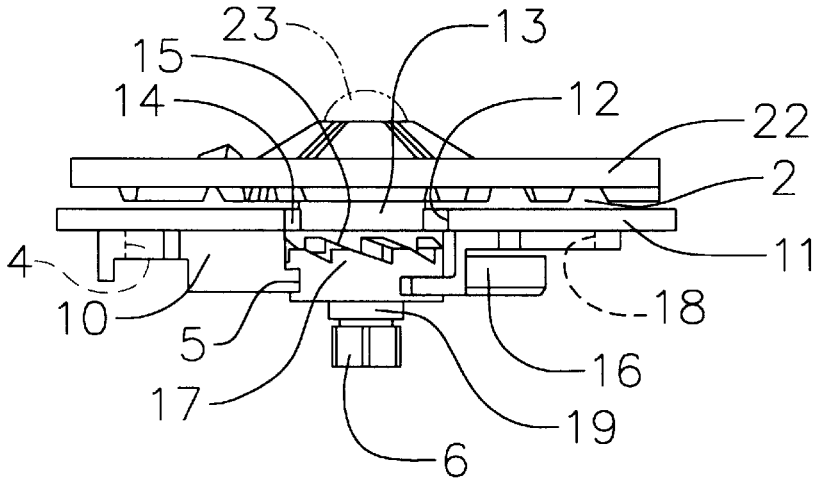
FIG. 4B is a view showing the apparatus in a second relative position.

The situation of FIG. 2 and 3 is shown in (A) of FIG. 4. That is, the operation body 16 is not operated. That is, the elevation body 13 completely meshes into gears with the operation body 16 via saw-teeth 15 and 17. In other words, the elevation body 13 has not projected from the substrate 11 and thereby spaces the disc 22 relative to the substrate 11 in a first relative position and related to the thickness of disc bodies accepted into openings in the disc 22. Therefore, since the space 3 of the substrate 11 and the disc 22 is the lowest, the thin disc bodies (not shown) such as coins are applicable. If the haft part of the operation body 16 is rotated when the disc bodies such as coins are thicker, the elevation body 13 will be adjusted via the engagement between saw-teeth 15 and 17. Therefore, as shown in (B) of FIG. 4, the space 2 of the substrate 1 1 and the disc 22 is increased and can adapt the thickness of thicker disc bodies such as thicker coins. That is, the inclination surface which forms the saw-teeth 15 of the elevation body 13 raises by the inclination surface which forms the saw-teeth 17 of the operation body 16. As a result, the elevation body 13 projects from the substrate 11 and displaces the disc 22 which it engages. The bottom of the elevation body 13 provides an inclination surface. The operation body 16 with the ramp contacted to an inclination surface is produced. And, the operation body 16 is slideably arranged for the substrate 11. In this case, the adjustment of the operation body 16 and disc 22 is provided without rotation. Therefore, the elevation body 13 and disc 22 can raise.

In addition, as to this above-mentioned example, the central-axis line of the whole apparatus is aligned along one central-axis line 41 as clearly shown in FIG. 3. That is, the central-axis line of the revolving shaft 19, the central-axis line of the thick disc type planetary gear apparatus 30 and the central-axis line of the electric motor 40 are lying in a straight line. For this reason, the structure becomes simple and firm. Moreover, the attachment of an apparatus becomes easy. Therefore, the disc bodies such as coins can be discharged from any selected direction of 360 degrees. Furthermore, if the disc 22 and the revolving shaft 19 are formed integrally, they can be coupled by one step only by the gear part 6 being inserted in the cylinder bore 34. In other words, they can couple only by the gear part 6 of the lower end of the revolving shaft 19 being inserted in the cylinder bore 34 of the carrier board 32.

Moreover, the discharge apparatus of this example can be simply adjusted to the coin thickness. For this reason, as the disc 22 corresponding to the size of various coins is ready, this apparatus is easily applicable to the coins of each country. In addition, as above mentioned, although the gear part 22 of the revolving shaft 19 and the bore 34 of the carrier board 32 have a hexagonal shape, respectively, these components may consist of star type or petal type. In other words, it is desirable that the hexagonal spine is the shape which is not deformed under a strong torque.

Figure 5:
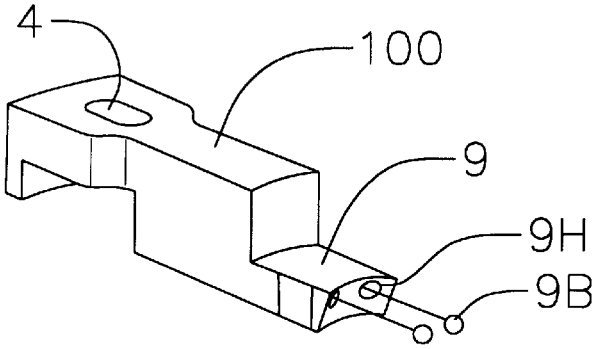
FIG. 5 is an enlarged perspective view of another example of the shaft retaining stopper of FIG. 1.

FIG. 5 shows the other example of a stopper 100. This stopper 100 is equivalent with two small-hole 9H at the apical surface of the wedge part 9 of a flea tooth shape. A small steel ball 9B is embedded via the grease for lubrication in the small hole 9H, respectively. In this way, as the wedge part 9 is in contact with the cone part 8 of the revolving shaft 19 via the steel ball 9B, the wedge part 9 is not worn out.

The discharge apparatus by this invention can also perform regulation of the coin thickness extremely simply and can easily exchange the discs for discharging a coin by one step.

Figure 6:
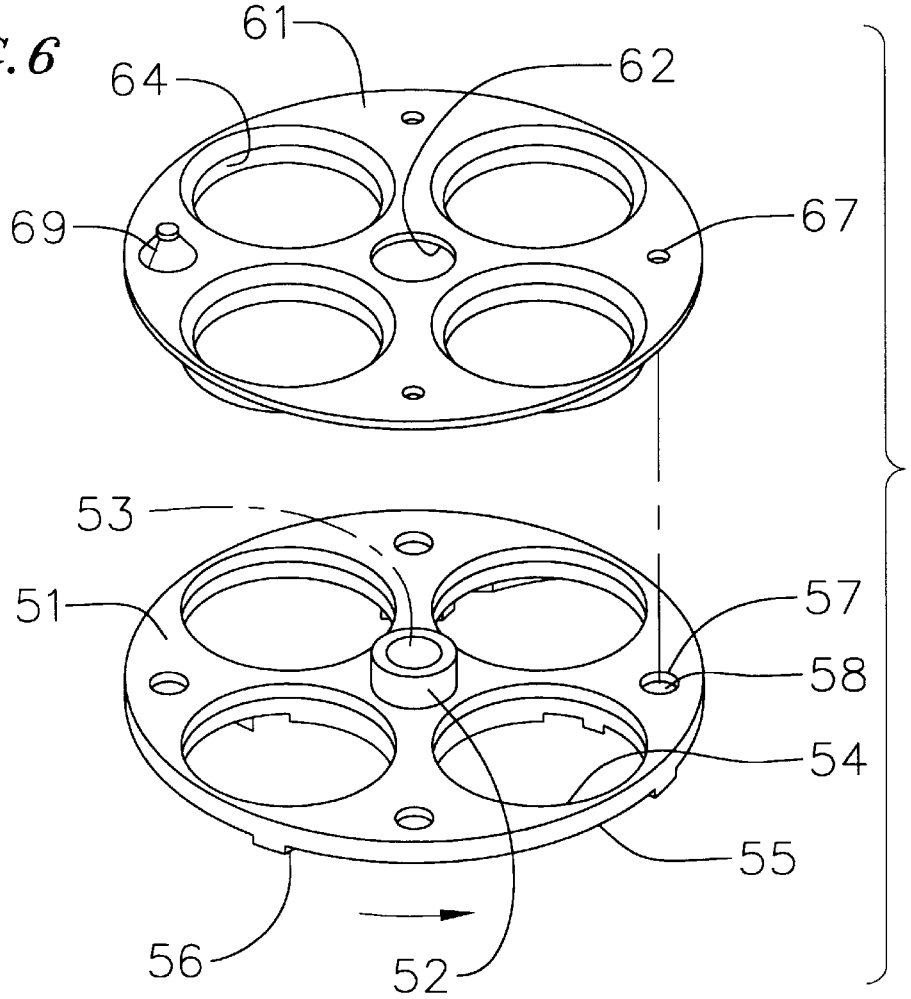
FIG. 6 is a perspective, exploded view and showing a further embodiment of the disc of this invention.

As to the disc 22 and as shown in FIG. 6, a thick large disc is the main disc 51 which forms the principal part of the discharge apparatus for discharging the disc body in accordance with this invention. The main disc 51 is made with a sintered metal or a die cast. The main disc 51 is inserted in the upper end part of a rotating shaft 53 via a cylinder part 52 formed in the central part and is secured.

The rotating shaft 53 is rotated counterclockwise (FIG. 6) by means of a drive unit comprising an electric motor and a gear apparatus (not illustrated). The main disc 51 is equipped in a peripheral direction with four fairly large openings 54 at equal intervals. The circumference part of the under-surface of the main disc 51 is equipped in a peripheral direction with four triangular type fairly large hollows 55 at equal intervals. Therefore, four long and slender cutoff notches formed on the long-side part of the triangle of a hollow 55 are formed on the circumference of the main disc 51.

The top part of the hollow 55 formed against a cutoff notch is connected to a through-hole 53. A long and slender arm 56 is formed between adjacent hollows. In addition, the long and slender arm 56 is notched. Therefore, when the main disc 51 rotates contact between a guide pin (not shown) and the long and slender arm 56 is prevented. Some small holes 57 are formed on the circumference part of the upper surface of the main disc 51. A small hole 57 embeds a forceful magnet 58 made from a rare earth metal.

As to the upper part of FIG. 6, a thin large disc is the iron cover disc 61 which forms the principal part of the discharge apparatus for the disc bodies in accordance with this invention. The cover disc 61 is equipped with an open hole 62 at its central part. An open hole 62 relieves the cylinder part 52. The cover disc 61 is in a peripheral direction equipped with four fairly large penetration tubes 64 at equal intervals adapted to register with openings 54. The penetration tube 64 is formed downward. In addition, the diameter and the depth of the penetration tube 64 are selected in consideration of the size of the disc body for which a discharge is desired. The circumference part of the cover disc 61 includes protrusions 67. The protrusions 67 face downward. Each protrusion 67 is received in the small hole 57 to couple the main and cover discs 51,61.

In addition, a stir pin 69 is used in place of the protrusion 67 suitably. In this case, the stir pin 69 is made from iron. And when the stir pin 69 is used, the cover disc 61 can also be molded by resin.

Figure 7:
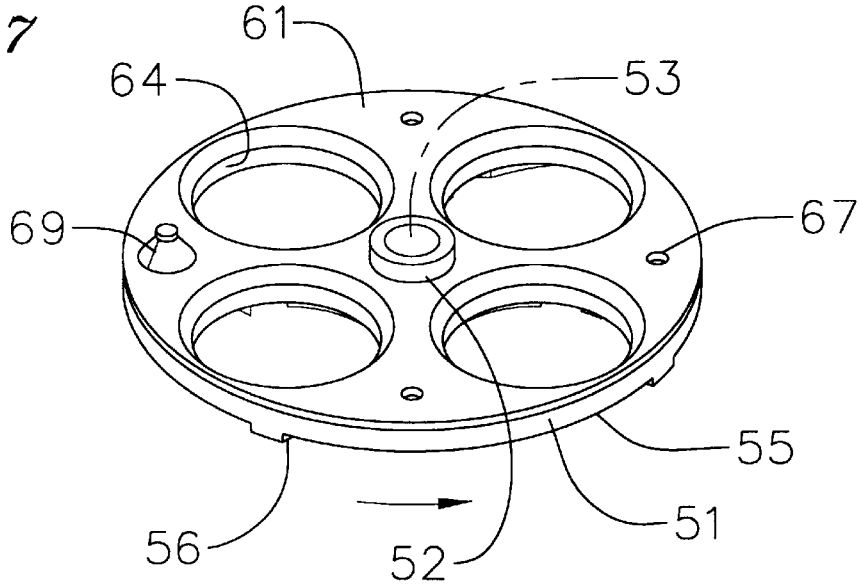
FIG. 7 is a perspective, assembled view of the disc of FIG. 6.

As to this example which consists of the above component, the cover disc 61 is put on the main disc 51. And, they are integrated as shown in FIG. 7. That is, the open hole 62 of the cover disc 61 is inserted in the cylinder part 52 of the main disc 51. Moreover, the protrusion 67 is put in the small hole 57. The protrusion 67 and magnets 58 retain the cover disc 61 to the main disc.

In this way, if the disc body comes from the upper part of FIG. 7, an electric motor (not shown) will operate. And, the cover disc 61 rotates counterclockwise. In this way, the disc body is put into the penetration tube 64 of any one of the cover disc 61. When the cover disc 61 rotates, the disc body put into the penetration tube 64 slides on the upper surface of a base (not shown). One disc body which slides on the upper surface of a base is pushed from the penetration tube 64 into the opening 55 by a guide pin (not shown) which projects from the upper surface of a base into the space between main disc 51 and base.

And, when the cover disc 61 is rotated further, one of the disc bodies is pushed by a regulation pin (not shown) which projects from the upper surface of a base. At this time, one of the disc bodies is moved radially outwardly to the exterior of the cover disc 61 by action of the arm 56. Furthermore, the cover disc 61 rotates, the disc body is pushed by only the arm 56 to the exterior of the cover disc 61 for discharge thereof. For this reason, the arm 56 is slotted in order to pass a guide pin or a regulation pin, respectively.

Figure 9:
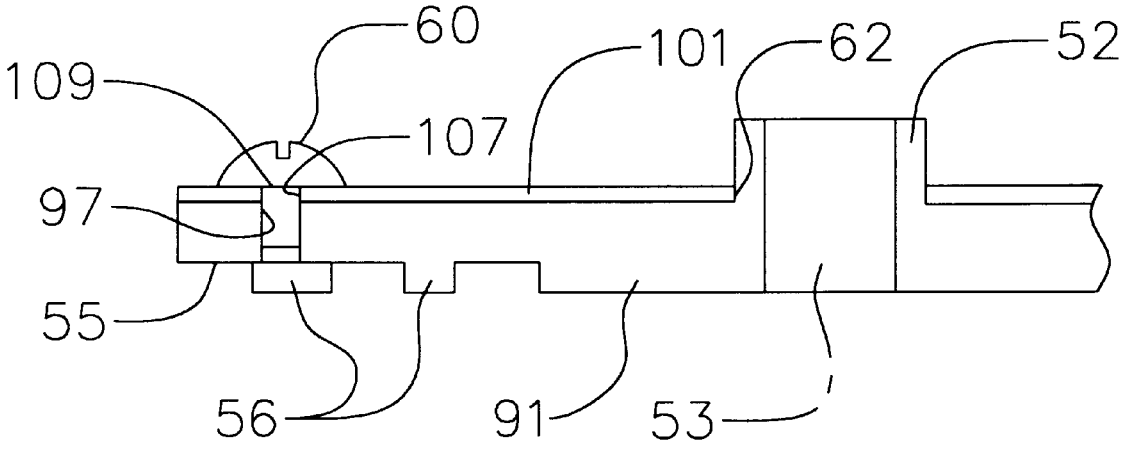
FIG. 9 is an enlarged sectional and elevational view of a further embodiment of the disc of FIG. 6.

FIG. 9 shows the enlarged principal part of the other example of this invention.

Figure 8A:
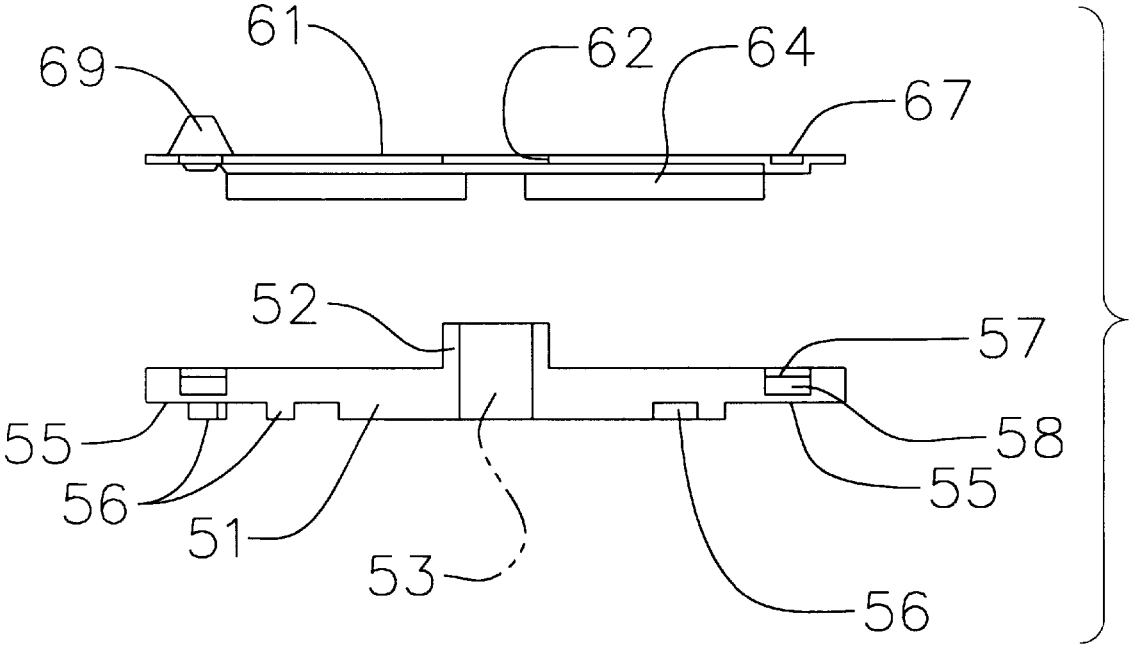
FIGS. 8A and B are an elevational view from FIG. 6, FIG. 7, respectively.
Figure 8B:
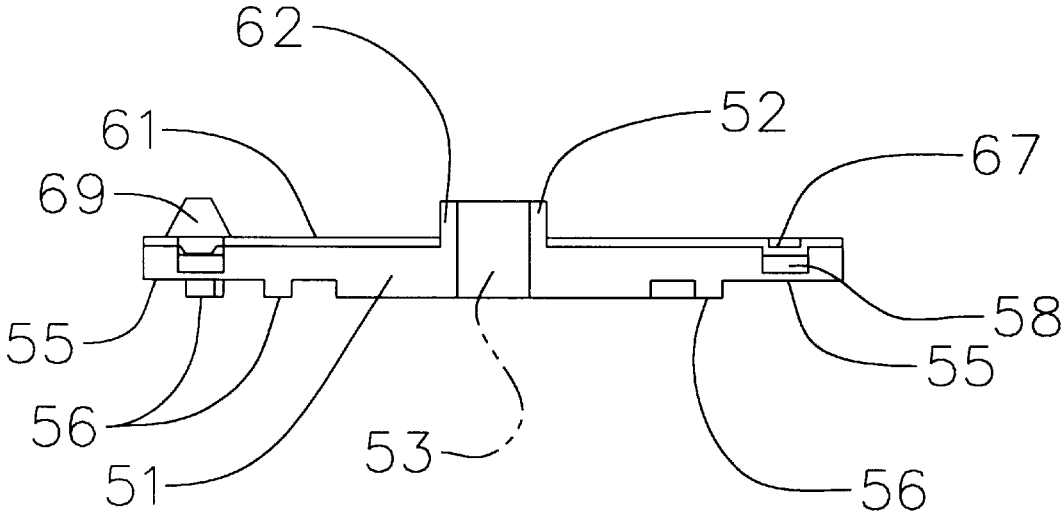

The circumference part of a main disc 91 forms a plurality of screw holes 97. And, the circumference part of a cover disc 101 forms a plurality of small holes 107. And, the cover disc 101 is put on the main disc 91. They are integrated as shown in FIG. 8. That is, the open hole 62 of the cover disc 101 is inserted in the cylinder part 52 of the main disc 91. And, screw 109 is penetrated in a small hole 107 and is fixed to the screw hole 97. In this case, the head part 110 of the Bis-screw 109 is used in place of the stir pin 69.

As mentioned above, according to this invention the main disc of a piece is provided. Furthermore, a plurality of cover discs corresponding to various coins is provided. Therefore, the discharge apparatus for the disc bodies which can change size of a discharge hole simply by only choosing a cover disc depending on the size of the disc body discharged according to this invention is obtained. In other words, the discharge apparatus forth disc bodies which can change size of a discharge hole simply depending on the size of the disc body discharged according to this invention is obtained. Especially, the discharge apparatus for the disc bodies according to this invention can exchange the disc for a discharge simply depending on the size of the required coin.

I claim:

1. A discharge apparatus for disc bodies comprising;

a fixed substrate;

a disc spaced from said substrate a distance related to the thickness of said disc bodies, said disc including at least one opening having a diameter adapted to receive a disc body;

means for rotating the disc to accent disc bodies in said opening and said space for discharge thereof, said rotating means including a shaft coupled between said disc and means for rotating the shaft for axial movement thereof and said adjusting means including an elevation body disposed about the shaft and at one end engaging the disc and at the other end including a plurality of axially extending projections and an operation body including a plurality of projections adapted to engage the projections on said elevation body, engagement of said projections displacing said disc to adjust said space.

2. The apparatus of claim 1 wherein, relative to said shaft, said projections on said elevation body and said operation body are arranged annularly and are adapted to, in response to rotation of said operation body, engage to displace said disc to adjust said space.

3. A discharge apparatus for disc bodies comprising;

a fixed substrate;

a disc spaced from said substrate a distance related to the thickness of said disc bodies, said disc including a main disc having coupled to one face thereof a cover disc, each including bores adapted to register to define at least one opening, said disc bodies accepted through said cover disc into said opening, said main disc including at least one arm disposed in said space and adapted to engage a disc body in said space for discharge thereof, said main and cover discs are coupled by one of said discs including a ferromagnetic element and the other including a magnetic element;

means for rotating the disc to accept disc bodies in said opening and said space for discharge thereof; and means for adjusting said space to accept disc bodies of differing thicknesses.

4. The apparatus of claim 3 wherein said cover disc includes a protruding pin adapted to stir said disc bodies.

5. A discharge apparatus for disc bodies comprising;

a fixed substrate;

a disc spaced from said substrate a distance related to the thickness of said disc bodies, said disc including at least one opening having a diameter adapted to receive a disc body;

a shaft coupled between said disc and means for rotating the shaft for axial movement thereof to space said disc relative to said substrate, rotation of said disc to accept disc bodies in said opening and said space for discharge thereof;

an elevation body disposed about the shaft and at one end engaging the disc and at the other end including a plurality of axially extending projections; and an operation body including a plurality of projections adapted to engage the projections on said elevation body, engagement of said projections displacing said disc to adjust said space to accept disc bodies of differing thicknesses.

6. The apparatus of claim 5 including a stopper to retain said shaft to said substrate.

7. The apparatus of claim 5 wherein said elevation body and operation body projections have a saw-tooth configuration.

* * * * *